US005746525A

United States Patent [19]

Sanda et al.

[11] Patent Number: 5,746,525

[45] Date of Patent: May 5, 1998

[54] PRINTER AND TRACTOR DEVICE THEREFOR

[75] Inventors: Tsuyoshi Sanda; Tsutomu Fujiwara, both of Shizuoka, Japan

[73] Assignee: Kabushiki Kaisha TEC, Tokyo, Japan

[21] Appl. No.: 745,609

[22] Filed: Nov. 8, 1996

[30] Foreign Application Priority Data

Nov. 10, 1995 [JP] Japan ..... 7-292517

[51] Int. Cl.[6] ..... B41J 11/50

[52] U.S. Cl. ..... 400/605; 400/611; 400/616; 400/636

[58] Field of Search ..... 400/605, 607, 400/607.2, 611, 616, 616.1, 616.2, 616.3, 636, 636.2, 624, 625

[56] References Cited

U.S. PATENT DOCUMENTS

| | | | |
|---|---|---|---|
| 4,688,957 | 8/1987 | Prevignano | 400/605 |
| 5,037,222 | 8/1991 | Quick et al. | 400/605 |
| 5,139,355 | 8/1992 | Yeager | 400/616.2 |
| 5,169,250 | 12/1992 | Tsuru et al. | 400/605 |
| 5,308,175 | 5/1994 | Ito | 400/605 |

FOREIGN PATENT DOCUMENTS

| | | |
|---|---|---|
| 3-222771 | 10/1991 | Japan . |
| 4-115967 | 4/1992 | Japan . |
| 4-355170 | 12/1992 | Japan . |

*Primary Examiner*—Christopher A. Bennett
*Attorney, Agent, or Firm*—Cushman, Darby & Cushman IP Group of Pillsbury, Madison & Sutro LLP

[57] ABSTRACT

The present invention is directed to a printer and comprises a printing mechanism, a paper guiding path connecting with the printing mechanism, a driving source for a paper conveying system, an output gear connected to an output shaft of the driving source, and a permanent tractor having an input gear. The selective transmission of power from the driving source to either the output gear or the input gear provided in the permanent tractor is performed by a power selecting mechanism operated by an operating member. Further, the printer comprises a second drive force selecting mechanism for independently displacing a cam member in the printer and a clutch section for severing the connection between the output gear and the auxiliary tractor in order to feed only the cut paper. Consequently, the cut paper and the continuous paper can be used individually or in a parallel manner, and an interrupting operation for preventing the continuous paper from being conveyed and feeding only the cut paper can be performed even in a state where the continuous paper is set in the permanent tractor and the auxiliary tractor.

18 Claims, 10 Drawing Sheets

PRINTER AND TRACTOR DEVICE THEREFOR

CROSS-REFERENCE TO RELATED APPLICATION

This application is related to copending and commonly owned U.S. patent application Ser. No. 08/553,016 filed Nov. 3, 1995, in the name of Tsutomu FUJIWARA, Tsuyoshi SANADA, the entire disclosure thereof being expressly incorporated herein by reference.

BACKGROUND OF THE INVENTION

Field of the Invention

The present invention relates to a printer allowing both a cut sheet of paper and a continuous sheet of paper to be set therein and allowing one of the two kinds of sheets to be selectively fed to a printing mechanism. The invention also relates to a tractor device as an external device adapted to be attached to such a printer. More particularly, the present invention relates to a printer which allows the cut paper to be fed to the printing mechanism even in a state that the continuous paper has been set in one of the tractor devices, and relates also to a tractor device, as an external device which performs the above-described operation.

Known is a printer provided with a tractor and a friction feed mechanism to selectively use as a printing sheet either a continuous sheet of paper having many tractor holes arranged with equal pitches along both side edges or a cut sheet of paper. The tractor has a structure such that a rotating member having a plurality of pins projecting from the outer circumference for engagement with the tractor holes of the continuous sheet is rotated to feed the continuous sheet. On the other hand, the friction feed mechanism has a structure such that a drive roller and a pinch roller supported separatably from the drive roller are rotated to feed the cut sheet.

There are various kinds of cut sheets of paper different in size. Such different kinds of cut sheets are stacked in various kinds of paper feed cassettes according to the different sizes, and the cut sheets in each paper feed cassette are fed one by one. Accordingly, the different kinds of cut sheets can be easily set in the printer. On the other hand, there are also various kinds of continuous sheets of paper; however, setting of each kind of continuous sheet in the tractor is troublesome. Accordingly, it is convenient that the printer is to be provided with plural kinds of tractors to allow quick change from one kind of continuous sheet into another. In order to achieve this objective, an optional tractor device, which is provided with a permanent tractor to be mounted on the printing apparatus is provided. The above-described conventional tractor device will be described with reference to FIGS. 10 and 11.

As shown in FIGS. 10 and 11, a permanent tractor 101 provided in a printer 100 is used to feed a continuous sheet 102 to a printing section (now shown), and in the case of selectively using either the continuous sheet 102 or another continuous sheet 103, an optional tractor device 105 having a tractor 104 is adapted to the printer 100. When the tractor device 105 is attached to the printer 100, the continuous sheet 103 is fed by the tractor 104 to the printing section.

The permanent tractor 101 in the printer 100 or the tractor 104 in the tractor device 105 includes a pair of right and left holders 108 slidably supported on a rotating shaft **106*a* or 106*b* and a guide shaft 107, a pulley (not shown) provided on each holder 108 driven by the rotating shaft 106*a* or 106*b*, an endless belt (not shown) wound around each pulley, and a paper presser 109 rotatably mounted on each holder 108. The outer circumference of each endless belt is formed with a plurality of pins (not shown) adapted to engage a plurality of tractor holes formed along both side edges of the continuous sheet 102 or 103**.

The permanent tractor 101 or 104 is driven by a drive gear 110 provided in the printer 100. When the tractor 104 in the optional tractor device 105 is to be driven, as shown in FIG. 11, rotation of the drive gear 110 is transmitted through gears 111, 112, and 113 and a shift gear 114 to an input gear 115 fixed to one end portion of the rotating shaft **106*b* of the tractor 104. On the other hand, when the permanent tractor 101 in the printer 100 is to be driven, the rotation transmitted through the shift gear 114 and gears 117 and 118 to an input gear 119 fixed to one end portion of the rotating shaft 106*a* of the permanent tractor 101 as shown in FIG. 10. The pair of gears 111 and 119, the pair of gears 112 and 118, and the pair of gears 113 and 117** are coaxially arranged in each pair, but are rotatable with no interference with each other in each pair.

The shift gear 114 is axially slidably supported, so as to selectively transmit the rotation of the gear 113 to either the input gear 115 or the gear 117. As shown in FIG. 10, a slider 120 is slidably supported inside of the printer 100 so as to be slid in a direction perpendicular to the axial direction of the shift gear 114. The slider 120 is normally biased obliquely upward toward the depth of the printer 100. The slider 120 is connected at its lower end by a wire 123 to a plunger 122 of a solenoid 121 provided in the tractor device 105. One side surface of the slider 120 is formed with a mountainous projection (not shown), and the shift gear 114 is normally biased so as to mesh with the gear 117. When the solenoid 121 is excited to retract the plunger 122, the slider 120 is pulled by the wire 123 to slide downward. As a result, the shift gear 144 is urged by the side projection of the slider 120 to come into mesh with the input gear 115.

There are a number of problems with the conventional printer and tractor therefor. In the conventional printer 100 as shown in FIGS. 10 and 11, if only the built-in tractor (permanent tractor) 101 is to be driven, it would be necessary to merely connect the input gear 119 fixed to one end of the rotating shaft **106*a* of the permanent tractor 101 through a single gear to the drive gear 110. However, to allow the optional tractor device 105 to be selectively driven, the plural gears are coaxially arranged. Accordingly, a power transmission structure is complicated, and the lateral size of the printer 100 is increased. Further, if the width of the printer 100** is limited, the width of a continuous sheet to be used is also limited.

Japanese Patent Laid-open No. Hei 4-115967 (laid open on Apr. 16, 1992) discloses a printer provided with a plurality of tractors and adapted to selectively drive these tractors by a single driving portion. Japanese patent Laid-open No. Hei 4-355170 (laid open on Dec. 9, 1992) discloses a printer provided with a plurality of detachable tractors and adapted to selectively connect these tractors to a driving portion by operating a lever to select gears.

However, these publications (Japanese Patent Laid-open Nos. Hei 4-115967 and Hei 4-355170) do not disclose any structure for feeding a cut sheet. Accordingly, the printers disclosed in these publications cannot support various use modes of plural kinds of printing sheets, so that both a cut sheet and a continuous sheet cannot be set in the printer simultaneously.

Japanese Patent Laid-open No. Hei 3-222771 (laid open on Oct. 1, 1991) discloses a printer provided with a plurality of pairs of tractors upstream in a paper feed direction to feed continuous sheets to the same printing position, wherein at least one pair of tractors are constructed as a unit which is detachable. This printer is further provided with a paper feeder for feeding a cut sheet to the printing position and a press roller adapted to come into pressure contact with a platen. This printer controls the tractors or the paper feeder so that when the cut sheet is to be fed to the printing position by the paper feeder, the press roller is brought into pressure contact with the platen. When the continuous sheet is to be fed to the printing position by the tractor, the press roller is brought out of contact with the platen.

In the printer disclosed in Japanese Patent Laid-open No. Hei 3-222771, the mechanism for driving the tractor is independent of the paper feeder, and the structure is therefore complicated, causing an increase in size of the printer.

SUMMARY OF THE INVENTION

It is accordingly a first object of the present invention to provide a printer and a tractor device therefor which allow the use of plural kinds of printing sheets in various modes.

It is a second object of the invention to provide a printer and a tractor device therefor which allow the feeding of cut paper even when two kinds of tractors are being selectively used.

It is a third object of the present invention to provide a printer and a tractor therefor which perform the above-described operation with a simplified structure.

It is a fourth object of the present invention to provide a printer and a tractor therefor which easily identify a tractor presently used when two kinds of tractors have been selectively used.

In accordance with an aspect of the present invention, there is provided a printer, comprising a printing mechanism; a paper guide path communicating with said printing mechanism; a driving source having an output shaft generating a feeding force; a permanent tractor located at a position communicating with said paper guide path for feeding a continuous sheet of paper, said permanent tractor having an input gear connected to the output shaft of said driving source, thereby applying the feeding force to the continuous sheet of paper through said permanent tractor; an output gear connected to said output shaft of said driving source; a drive force selecting mechanism for selectively transmitting a drive force from said driving source to one of said input gear of said permanent tractor and said output gear; a movable operating member for operating said drive force selecting mechanism; a slider connected to said operating member, said slider being slid by the movement of said operating member; a cam member provided on said slider so that said cam member independently slides along the surface of said slider in a first state and also integrally slides with said slider in a second state, said cam member operating said drive force selecting mechanism by integrally sliding with said slider when said operating member is moved; an external device connecting portion selectively allowing attachment and detachment of one of an automatic sheet feeder for successively feeding a plurality of cut sheets of paper and a tractor device for feeding a continuous sheet of paper so that a paper feed mechanism of one of said automatic sheet feeder and said tractor device communicates with said paper guide path and said output gear is connected to an input gear of said paper feed mechanism; a second drive force selecting mechanism mounted in said tractor device for operating said drive force selecting mechanism by displacing independently said cam member; and a clutch member connected between said tractor device and said output gear. Accordingly, the printer allows the feeding of a single cut paper even when two kinds of tractors have been selectively used.

BRIEF DESCRIPTION OF THE DRAWINGS

FIG. 5(*b*) is a plan view showing a condition where an operating member is operated to make a shift gear mesh with an input gear of a permanent tractor;

FIG. 7(*b*) is a side view showing a coupling mechanism and operation of the slider and the cam member in the case of using a permanent tractor;

FIG. 7(*c*) is a side view showing a coupling mechanism and operation of the slider and the cam member in the case of using an auxiliary tractor;

FIG. 8(*b*) is a side view showing a structure and operation of a clutch section in power disconnected state.

DETAILED DESCRIPTION OF THE INVENTION

A first embodiment of the present invention will be described on the basis of FIGS. 1 to 8.

Figure 2:
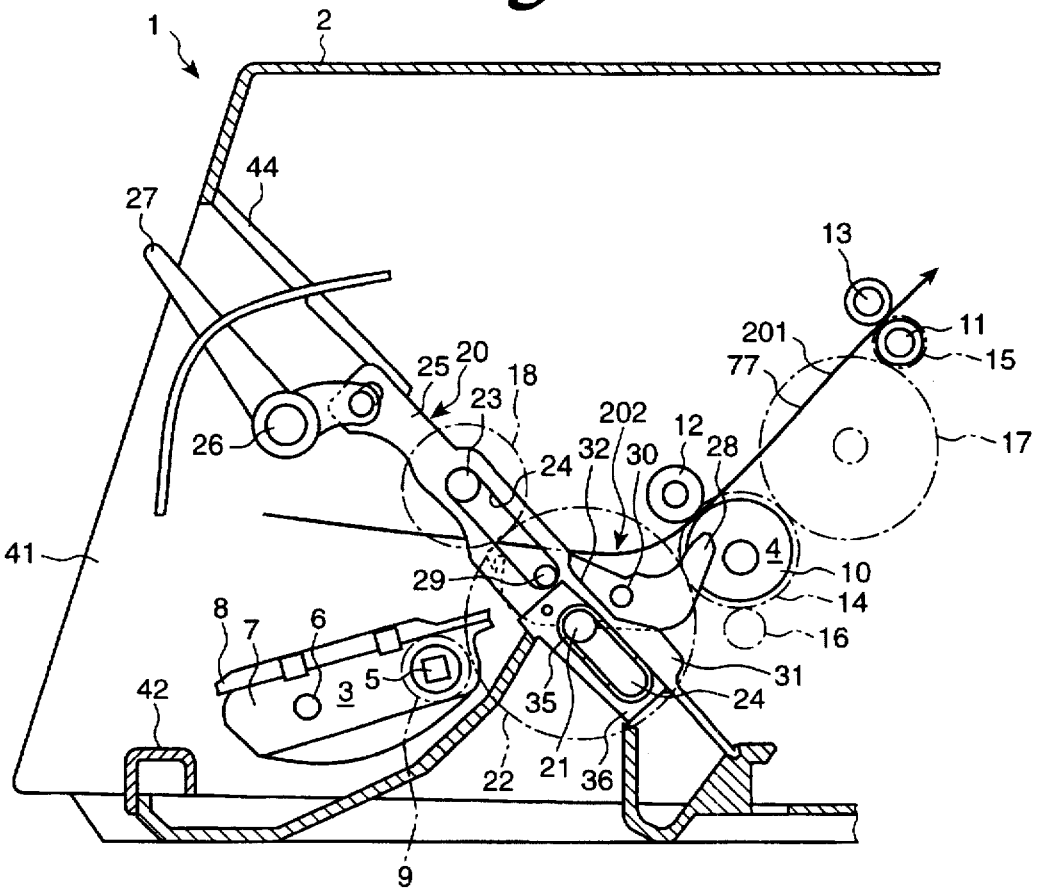
FIG. 2 is a vertical sectional side view showing a condition where a cut sheet of paper is fed by the printer only.
Figure 3:
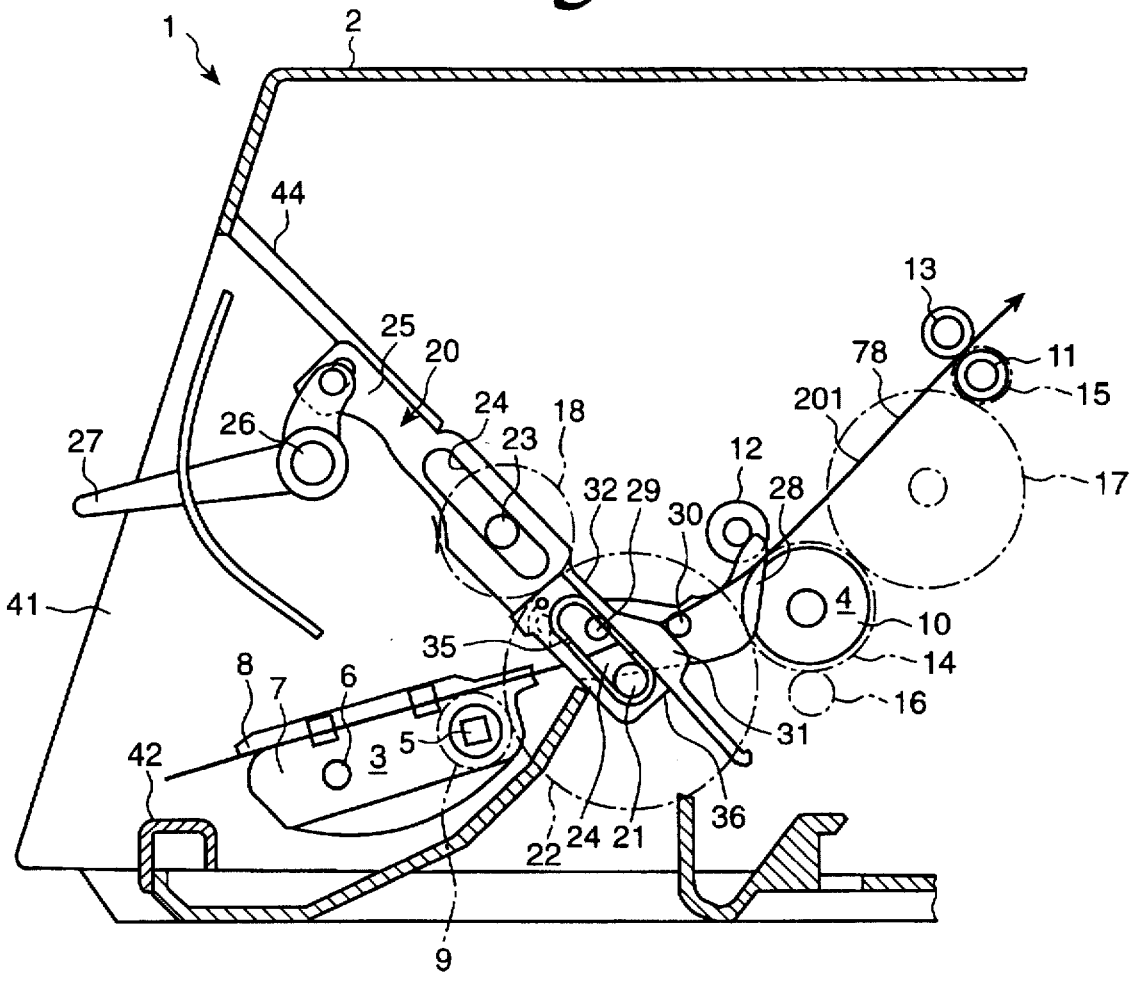
FIG. 3 is a vertical sectional side view showing a condition where a continuous sheet of paper is fed by the printer only.

A printer 1 will be described. FIGS. 2 and 3 illustrate the internal construction of the printer 1. A permanent tractor 3, a friction conveying mechanism 4, and a printing mechanism (not shown) are successively arranged along a paper guiding path 201 from the left to the right in a printer main body 2. The permanent tractor 3 is constructed by providing a pair of right and left holders 7 slidably held by a rotating shaft 5 and a guiding shaft 6. Each holder 7 has a pulley (not shown) driven by the rotating shaft 5. An endless belt (not shown) having a plurality of pins along its outer periphery is wound around each pulley. A paper cover 8 is mounted so as to be capable of freely rising and falling. An input gear 9 is fixedly fitted to one end of the rotating shaft 5.

The above-mentioned friction conveying mechanism 4 comprises driving rollers 10 and 11 and pinch rollers 12 and 13 which are pressed against the driving rollers 10 and 11. Driving roller gears 14 and 15 are fixedly fitted to ends of the driving rollers 10 and 11. The driving roller 10 is rotated by receiving the rotation of a motor (not shown) serving as a driving source through a driving gear 16 and the driving roller gear 14. The driving roller 11 is rotated by transmitting the rotation of the driving roller gear 14 to the driving roller gear 15 through a transmission gear 17.

An output gear 18 is provided on one side of the printer main body 2. A drive force selecting mechanism 20 for selectively transmitting the rotation of the driving gear 16 to the input gear 9 of the permanent tractor 3 or to the output gear 18 is provided on one side of the printer main body 2. The drive force selecting mechanism 20 comprises a shift gear 22 slidably supported along the axis of a supporting shaft 21, and a slider 25 having a long hole 24 whose linear movement is guided by a supporting shaft 23 for supporting the output gear 18 and the supporting shaft 21. The slider 25 is a linear cam mechanism which is linearly moved by rotating an operating member 27 around a supporting shaft 26.

Furthermore, as shown in FIG. 5 the drive force selecting mechanism 20 is so constructed that the supporting shaft 23 for supporting the output gear 18 and the supporting shaft 21 for supporting the shift gear 22 are respectively provided upright on a side plate 2*a* in the printer main body 2, and a spring 33 serving as an urging section for urging the shift gear 22 in one direction is wound around the supporting shaft 21 with a collar. A projection 34 so inclined that its radius is gradually decreased in the direction away from the spring 33 is formed on a side surface of the shift gear 22, and a projection 35 for pressing the shift gear 22 against the urging force of the spring 33 is formed on a side surface of the slider 25.

A separating mechanism 202 is depicted in FIG. 2. The separating mechanism 202 is a mechanism for separating the pinch roller 12 from the driving roller 10. Specifically, a releasing member 28 urged in a clockwise direction is rotatably provided around a supporting shaft 29 on one side of the printer main body 2.

The releasing member 28 has a pin 30 provided on its side surface, and is rotated in a counterclockwise direction around the supporting shaft 29 to separate the pinch roller 12 from the driving roller 10 when the pin 30 is pressed upwards by a projection 31 of the slider 25. The releasing member 28 is rotated in a clockwise direction to allow contact of the pinch roller 12 with the driving roller 10 when pin 30 reaches a recess 32 on the slider 25.

Figure 4:
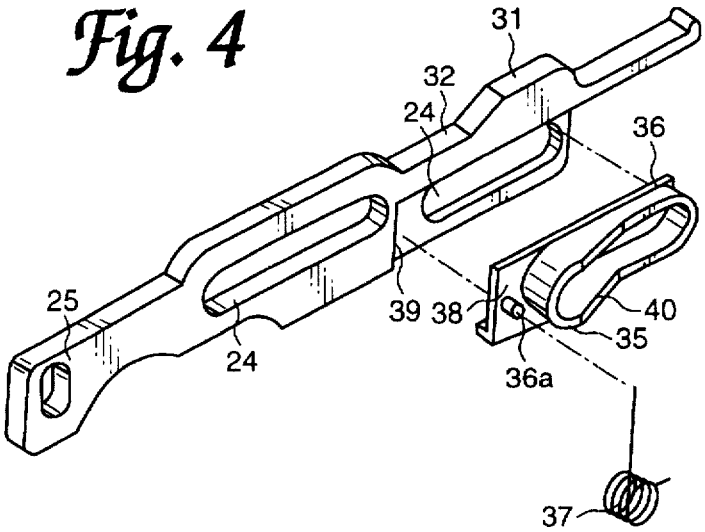
FIG. 4 is an exploded perspective view showing a relation between a slider and a cam member.

As shown in FIGS. 4 and 7, a cam member 36 is slidably held in the direction in which the slider 25 slides (along the length of the long hole 24) in the slider 25. The cam member 36 is urged in one direction by a torsion coil spring 37, and generally slides integrally with the slider 25 with its edge 38 abutting against an engaging edge 39 of the slider 25. A projection 35 for pressing the side surface of the shift gear 22 is formed in the cam member 36. The projection 35 has an inclined portion 40 formed along the peripheral edge of the long hole 24 below the slider 25, the height of which is gradually decreased in the direction away from the operating member 27.

Figure 1:
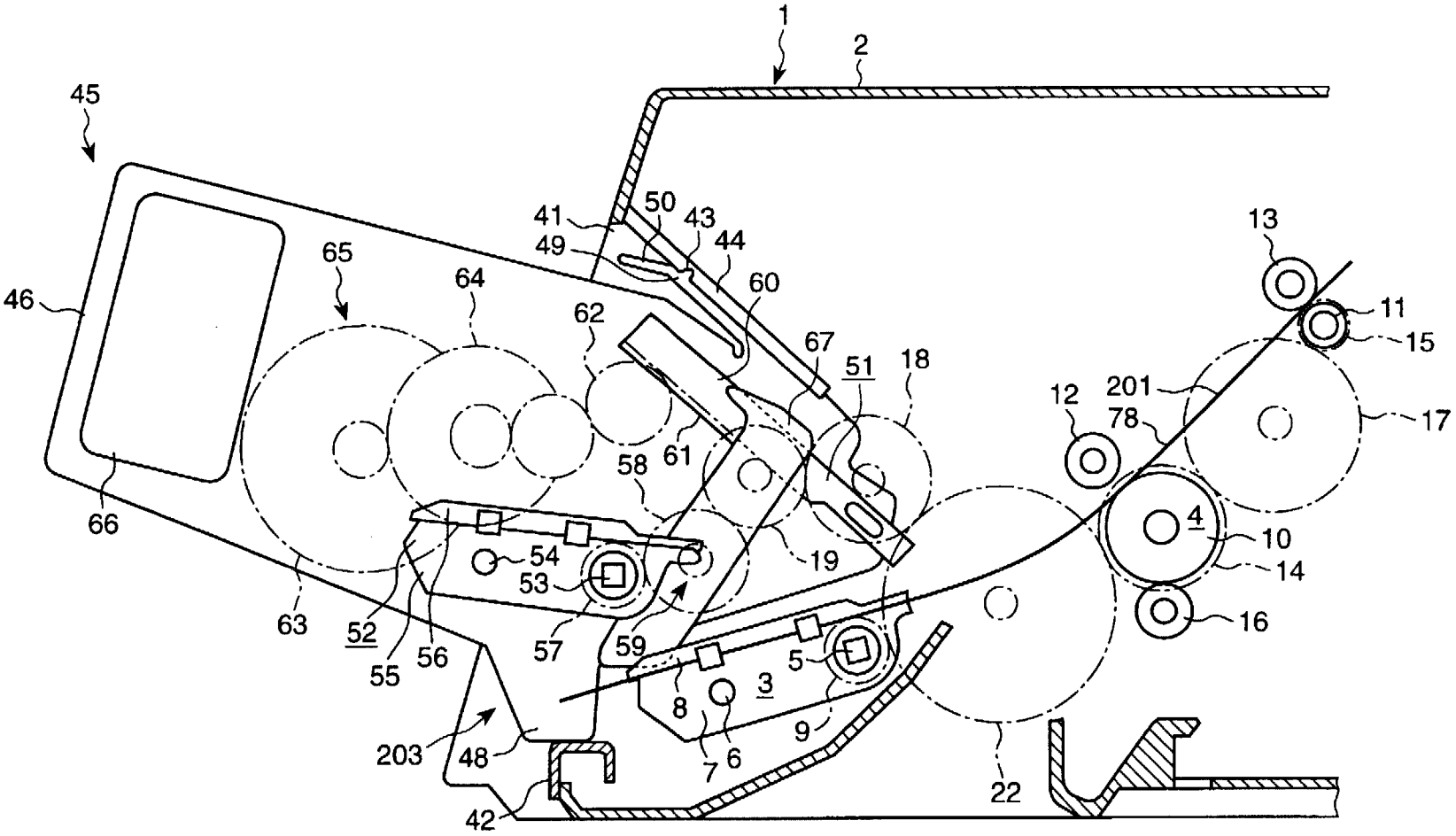
FIG. 1 is a vertical sectional side view of a first preferred embodiment of the present invention, showing a condition where a tractor device is mounted in a printer.

As shown in FIGS. 1 to 3, an opening 41 is formed in the front of the printer main body 2. A built-on device connecting section 203 for allowing selective attachment and detachment of a tractor device 45 and an automatic sheet feeder 73 as described later is provided in the opening 41.

Figure 6:
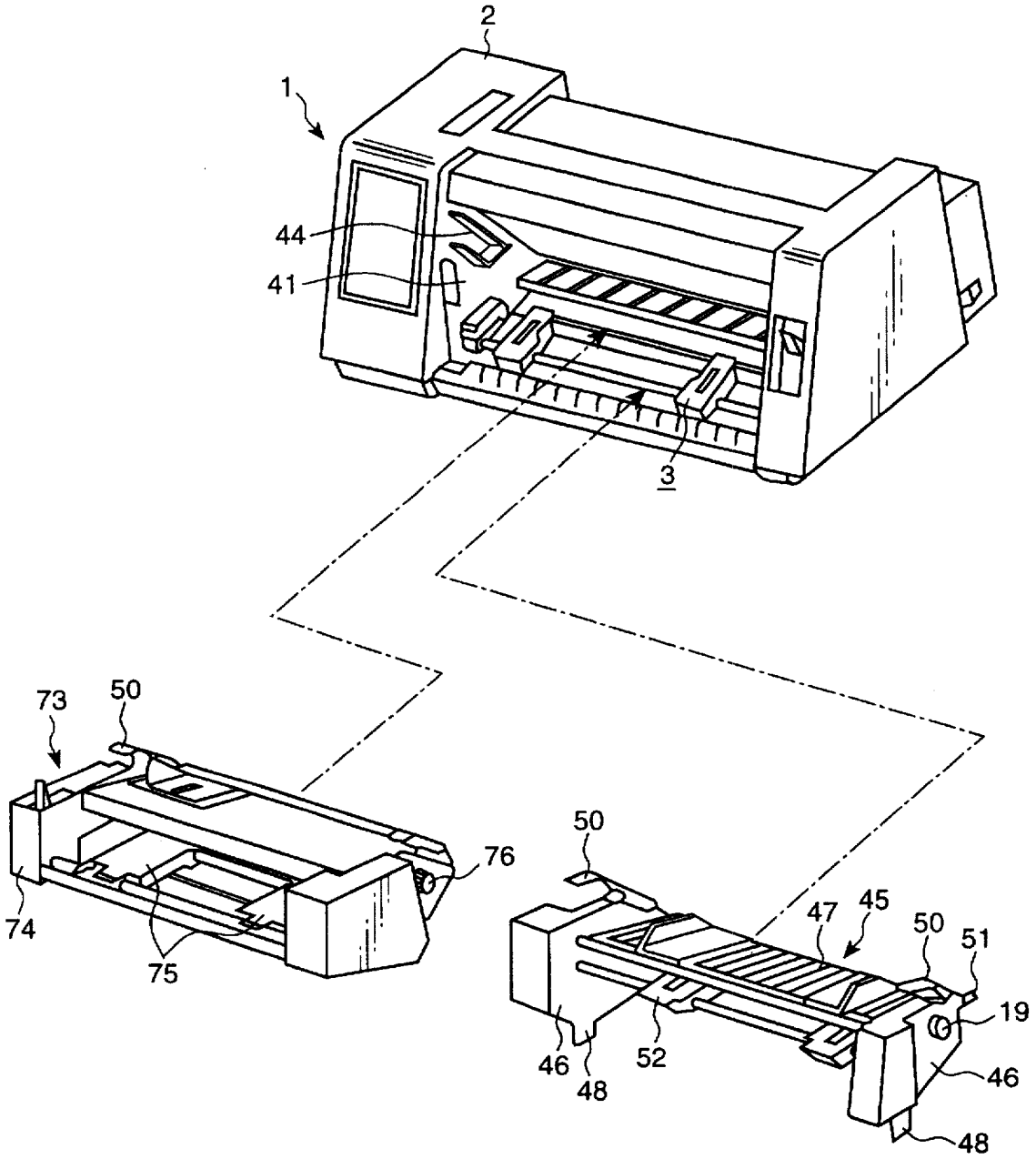
FIG. 6 is an exploded perspective view showing a relation between the printer and either an automatic sheet feeder or the tractor device to be selectively mounted into the printer.

A supporting section 42 is formed in the lower part of the opening 41, and supporting members 44 having engaging recesses 43 are disposed on both sides of the upper part of the opening 41. The optional tractor device 45 is selectively mounted in the opening 41 of the printer main body 2. Elastic members 50 formed on both sides of tractor device 45 engage the recesses 43. As shown in FIG. 6, the tractor device 45 has a manual setting table 47 for feeding cut paper and side plates 46 which are opposite to each other. Projections 48 supported by the supporting section 42 in the printer main body 2 are formed on both sides of the tractor device 45.

The tractor device 45 is provided with an auxiliary tractor 52 and a second drive force selecting mechanism 51. The auxiliary tractor 52 is formed by providing a pair of right and left holders 55 slidably held by a rotating shaft 53 and a guiding shaft 54. Each holder has a pulley (not shown) driven by the rotating shaft 53 and an endless belt (not shown) having a plurality of pins along its outer periphery and wound around the pulley.

The tractor device has a paper cover 56 which can be raised. A tractor gear 57 is fixedly fitted to one end of the rotating shaft 53. The tractor gear 57 is connected to an input gear 19 through an idle gear 58. When the idle gear 58 is disengaged from the tractor gear 57, however, power from the input gear 19 is maintained in its disconnected state. The structure of a clutch section 59 for intermittently transmitting the power will be described later. The input gear 19 is disposed outside the tractor device 45 so as to be engaged with the above-mentioned output gear 18 when the tractor device 45 is mounted in the opening 41 of the printer main body 2.

The second drive force selecting mechanism 51 has an operating lever 60, and presses the pin 36*a* of the cam member 36 to independently move the cam member 36 downward when the operating lever 60 is moved toward the lower right, while allowing the returning operation of the cam member 36 by the urging force of the torsion coil spring 37 when the operating lever 60 is moved toward the upper left. A rack 61 is formed in the operating lever 60. A driving mechanism 65 for driving the second drive force selecting mechanism 51 is constituted by a gear 62 engaged with the rack 61 and a gear train 64 for transmitting to the gear 62 the rotation of a motor 63 provided in the tractor device 45.

Furthermore, there is provided a clutch section 59 for selectively interrupting the transmission of power between the tractor gear 57 of the auxiliary tractor 52 and the output gear 18 when a mode for separating the pinch roller 12 from the driving roller 10 as well as transmitting the rotation of the driving gear 16 to the output gear 18 through the shift gear 22 is selected.

As shown in FIG. 8, the clutch section 59 comprises: the input gear 19 on the side of the tractor device 45 engaged with the output gear 18 on the side of the printer 1, a rotating member 67 rotated around the axis of the input gear 19, the idle gear 58 rotatably supported on the rotating member 67 and always engaged with the input gear 19, an urging member 68 for urging the rotating member 67 in the direction in which the idle gear 58 is engaged with the tractor gear 57 of the auxiliary tractor 52, and a pressing section 69 formed integrally with the operating lever 60 of the second drive force selecting mechanism 51 for pressing the rotating member 67 to disengage the idle gear 58 from the tractor gear 57 when the operating lever 60 is moved toward the upper left.

In order to maintain a predetermined backlash between the tractor gear 57 and the idle gear 58, there is provided a stopper 70 for supporting the rotating member 67. The idle gear 58 receives a force for disengagement from the tractor gear 57 rotated at a predetermined position at the time of transmitting rotation. In order to prevent the idle gear 58 from being disengaged from the tractor gear 57, however, a flexing member 71 is formed at one end of the rotating member 67. A receiving section 72 abutting against the flexing member 71 to prevent the rotary motion in a counterclockwise direction of the rotating member 67 is formed in the operating lever 60. Since the receiving section 72 comes off the flexing member 71 when the operating lever 60 is moved toward the upper left, it is so constructed as to allow the rotary motion in a counterclockwise direction of the rotating member 67 when the pressing section 69 presses the rotating member 67. Upon further movement of the operating lever 60 toward the upper left as shown in FIG. 8(B) to disengage the idle gear 58 from the tractor gear 57, the clutch section 59 is maintained in its power disconnected state.

As shown in FIG. 6, the automatic sheet feeder 73 is selectively mounted in the opening 41 of the printer main body 2. A housing 74 of the automatic sheet feeder 73 has the same dimensional shape as that of the tractor device 45. The housing 74 is provided with a cut paper guide 75 for guiding both side edges of cut paper, an input gear 76 provided on one side of the housing 74 and engaged with the output gear 18 in the printer main body 2 (see FIGS. 1 to 3), and a paper feeding roller (not shown) connected to the input gear 76.

Elastic members 50 (having the same structure as that of the elastic members 50 in the tractor device 45) which engage the recesses 43 on the printer body 2 are formed on both sides of the housing 74.

Figure 5A:
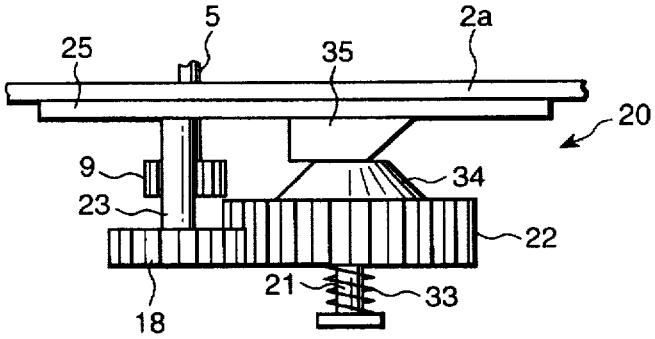
FIG. 5(*a*) is a plan view showing a condition where an operating member is operated to make a shift gear mesh with an output gear.
Figure 7A:
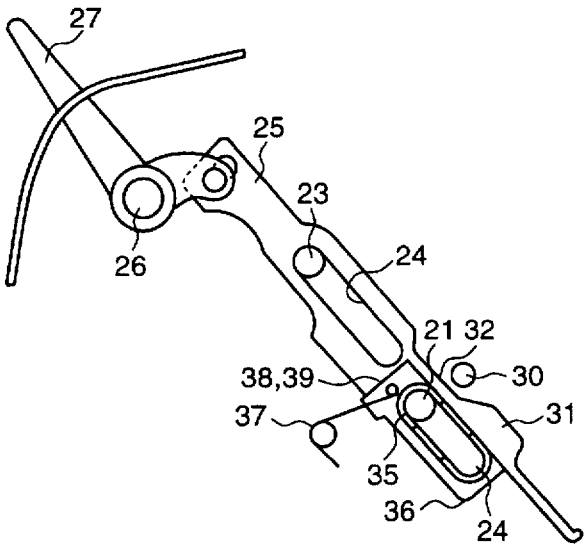
FIG. 7(*a*) is a side view showing a coupling mechanism and operation of a slider and a cam member in the case of using a friction feed mechanism.

In such construction, when cut paper 77 is fed, the operating member 27 is rotated upward, as shown in FIGS. 2 and 7(A). Consequently, the slider 25, together with the cam member 36, integrally slides toward the lower right. At this time, the projection 35 of the cam member 36 presses the projection 34 of the shift gear 22, as shown in FIG. 5(A), whereby the shift gear 22 is engaged with the output gear 18. FIG. 2 depicts a state where rotation is transmitted from the driving gear 16 to the driving roller gear 14, then to the shift gear 22 and to the output gear 18. The driving rollers 10 and 11 are always connected to the driving gear 16. If the driving gear 16 is driven, therefore, the driving rollers 10 and 11 and the shift gear 22 are rotated.

The separating mechanism 202 is also operated by upward movement of the operating member 27. Specifically, the slider 25 and the cam member 36 slide obliquely downward, so that the pin 30 of the releasing member 28 enters the recess 32 from the projection 31. Accordingly, the releasing member 28 is rotated in a clockwise direction around the supporting shaft 29 by the urging force. Consequently, the pinch roller 12 is pressed against the driving roller 10 by the urging force. As a result, the cut paper 77 is fed to the printing mechanism while being interposed between the driving rollers 10 and 11 and the pinch rollers 12 and 13.

When the cut paper 77 is fed, a driving force is transmitted to the output gear 18, whereby the cut paper 77 can be automatically fed by mounting the automatic sheet feeder 73 on the printer main body 2 and transmitting the driving force from the output gear 28 to the input gear 76. The cut paper 77 can be also manually fed without using the automatic sheet feeder 73.

Figure 5B:
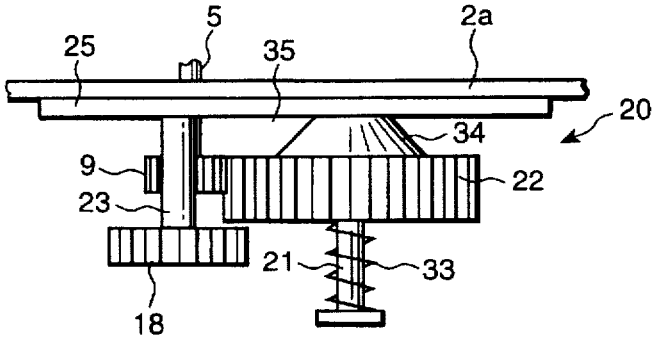
Figure 7B:
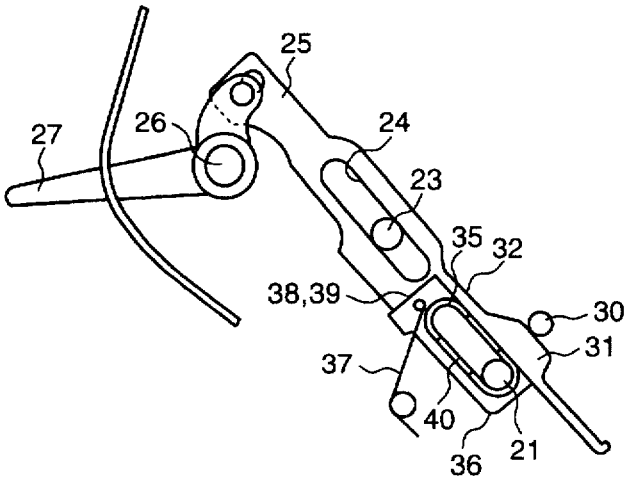

As shown in FIGS. 3 and 7(B), when continuous paper 78 is fed upon driving only the permanent tractor 3 in the printer main body 2, the operating member 27 is rotated downward. Consequently, the slider 25, together with the cam member 36, integrally slides toward the upper left. At this time, as shown in FIG. 5(B), the projection 35 of the slider 25 is separated from the projection 34 of the shift gear 22, whereby the shift gear 22 is engaged with the input gear 9 of the permanent tractor 3 upon being axially moved by the urging force of the spring 33. Specifically, in FIG. 3, a state is maintained where rotation transmitted from the driving gear 16 to the driving roller gear 14 is transmitted to the input gear 9 through the shift gear 22.

The separating mechanism 202 is also operated with the downward rotation of the operating member 27. Specifically, the slider 25, together with the cam member 36, integrally slides toward the upper left, so that the projection 31 presses the pin 30 of the releasing member 28. Accordingly, the releasing member 28 is rotated in a counterclockwise direction around the supporting shaft 29. Consequently, the pinch roller 23 is separated from the driving roller 10, whereby the continuous paper 78 can be fed by the permanent tractor 3 without being affected by the peripheral speed of the driving roller 10.

When two types of continuous paper 78 are properly used, the tractor device 45 is mounted in the opening 41 of the printer main body 2, as shown in FIGS. 1 and 6, in a state where the operating member 27 is rotated downward (at the same position as that shown in FIG. 7 (B)) to separate the pinch roller 12 from the driving roller 10, as shown in FIGS. 3 and 7 (C).

In this state, the input gear 19 in the tractor device 45 is engaged with the output gear 18 in the printer main body 2. Since the shift gear 22 is engaged with the input gear 9, however, the rotation of the driving gear 16 is not transmitted to the output gear 18, whereby the continuous paper 78 can be fed by the permanent tractor 3.

When paper is fed using the auxiliary tractor 52 in the tractor device 45 in the state shown in FIG. 1, the operating lever 60 of the second drive force selecting mechanism 51 in the tractor device 45 is moved toward the lower right by the driving mechanism 65, to press the cam member 36. The moving range of the operating lever 60 at this time is a range from A to B shown in FIG. 8 (A). In this range A–B, the rotating member 67 is stopped upon abutting against the stopper 70, to maintain a state where the idle gear 58 is engaged with the tractor gear 57.

Figure 7C:
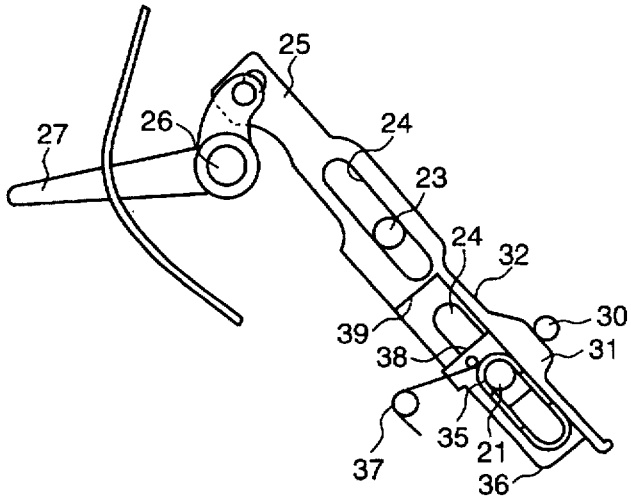

By the operation of the operating lever 60, the cam member 36 is moved away from the engaging edge 39 of the slider 25 against the urging force of the torsion coil spring 37 as shown in FIG. 7(C), so that the projection 35 presses the projection 34 of the shift gear 22. Therefore, the shift gear 22 is disengaged from the input gear 9 of the permanent tractor 3 and is engaged with the output gear 18. Consequently, rotation transmitted from the driving gear 16 to the shift gear 22 is transmitted to the tractor gear 18, the input gear 19, and the idle gear 58, whereby the continuous paper 78 set on the tractor device 45 can be fed by the auxiliary tractor 52.

Figure 8A:
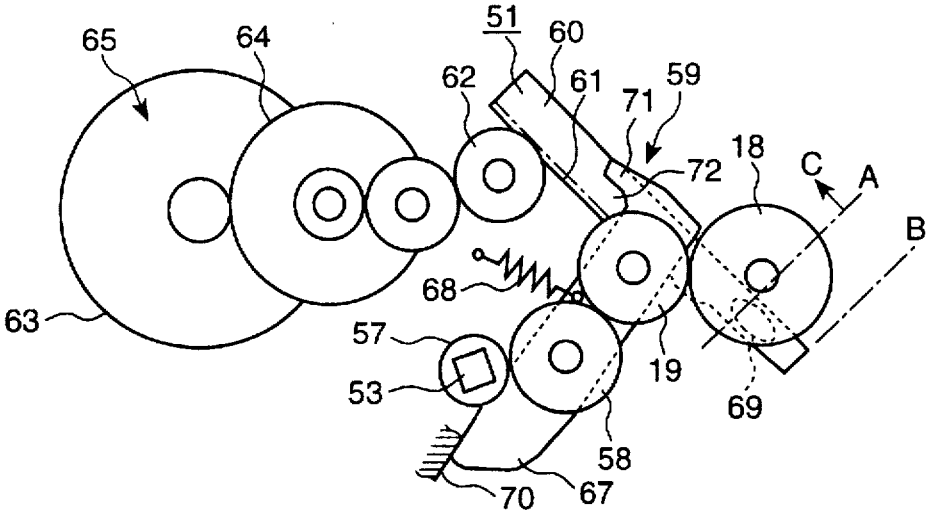
FIG. 8(*a*) is a side view showing a structure and operation of a clutch section in power transmitted state.
Figure 8B:
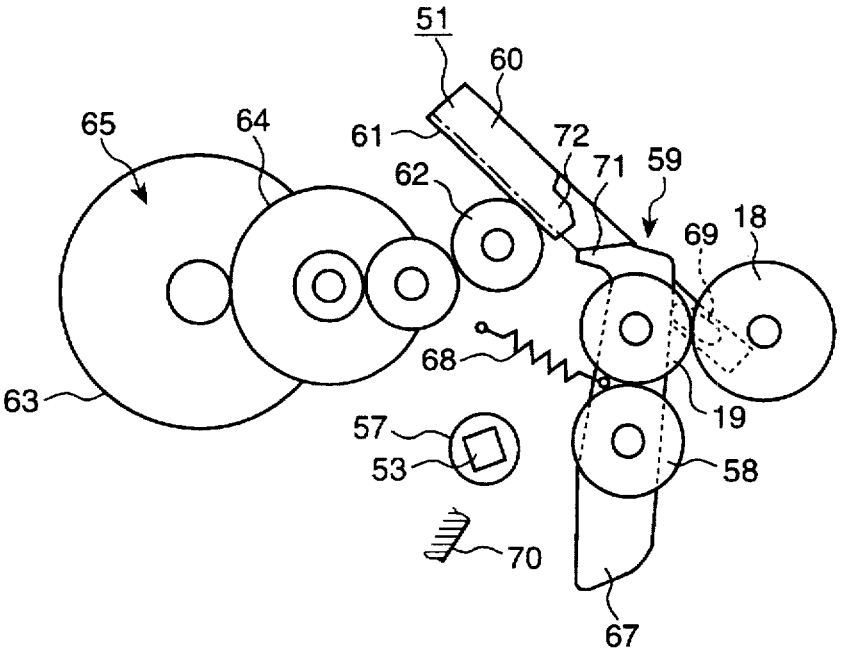

As shown in FIG. 8(A), when the clutch section 59 is maintained in its power transmitted state, where rotation transmitted to the output gear 18 is transmitted to the tractor gear 57 through the input gear 19 and the idle gear 58, the rotating member 67 is supported at a predetermined position by the stopper 70 upon being urged by the urging member 68, whereby the backlash between the idle gear 58 and the tractor gear 57 can be kept constant.

Furthermore, the idle gear 58 pivoted on the rotating member 67 receives a force for disengagement from the tractor gear 57 rotated at a predetermined position. The idle gear 58 is prevented from being disengaged from the tractor gear 57 by the flexing member 71 of the rotating member 67. The movement of the rotating member 67 in a counterclockwise is regulated by the receiving section 72 of the operating lever 60. Consequently, the transmission of rotation can be smoothly performed.

When the operating lever 60 is returned from the position B to the position A shown in FIG. 8(A) by the driving mechanism 65, the permanent tractor 3 is switched to its usable state again. The cam member 36 is then returned upward by the urging force of the torsion coil spring 37, as shown in FIGS. 4 and 7(B). Consequently, the shift gear 22 is engaged with the input gear 9 of the permanent tractor 3. At this time, in a range in which the operating lever 60 is moved from the position B to the position A, as shown in FIG. 8 (A), the pressing section 69 has not abutted against the rotating member 67 yet. Therefore, the rotating member 67 is maintained in a state where it abuts against the stopper 70, so that the idle gear 58 is engaged with the tractor gear 57. Since no power is transmitted to the output gear 18, however, the tractor gear 57 is not rotated.

When the tractor device 45 is mounted on the printer main body 2 and the operating member 27 is rotated upward to slide the slider 25 toward the lower right, as shown in FIG. 7(A), the pinch roller 12 is pressed against the driving roller 10 as described above. Therefore, the cut paper 77 can be fed by the driving roller 10 and the pinch roller 12 from the manual setting table 47 in the tractor device 45.

In this mode, the slider 25, together with the cam member 36, is moved toward the lower right, whereby the connection between the permanent tractor 3 and the driving gear 16 is severed, and an area between the driving gear 16 and the output gear 18 is maintained in its power transmitted state. When the operating lever 60 is further moved toward the upper left (in a direction indicated by an arrow C) from the position A by the driving mechanism 65, as shown in FIG. 8(A), the pressing section 69 of the operating lever 60 presses the rotating member 67. Therefore, the rotating member 67 is rotated in a counterclockwise direction around the axis of the input gear 19 against the urging force of the urging member 68, whereby the idle gear 58 is disengaged from the tractor gear 57, as shown in FIG. 8(B). Thus, the clutch section 59 is switched to the power disconnected state.

If continuous paper 78 is set in the permanent tractor 3 or the auxiliary tractor 52, it is possible to perform this interruption processing such that the continuous paper 78 is prevented from being fed, and only the cut paper 77 is fed. In this case, in a state before the clutch section 59 is disengaged, the rotary motion in a counterclockwise direction of the rotating member 67 is prevented by the receiving section 72 of the operating lever 60, as shown in FIG. 8(A). Thus, the urging fore of the urging member 68 need not be great. Therefore, it is possible to decrease an operating force for moving the operating lever 60 toward the upper left (in the direction indicated by the arrow C) to disengage the clutch section 59. Consequently, the load applied to the motor 63 can be reduced. When the operating lever 60 is moved toward the lower right by the driving mechanism 65 from a state where the clutch section 59 is disengaged as shown in FIG. 8 (B), the rotating member 67 is released from the pressing section 69, whereby the rotating member 67 is returned in a clockwise direction by the urging force of the urging member 68, to engage the idle gear 58 with the tractor gear 57.

Since the engagement and disengagement of the clutch section 59 can be switched utilizing the operation of the operating lever 60 of the second drive force selecting mechanism 51, an operating mechanism need not be separately provided. Power can be intermittently transmitted by displacing the idle gear 58 which is one of power transmitting components for transmitting the rotation of the output gear 18 to the tractor gear 57. Therefore, it is possible to decrease the number of components of the clutch section 59.

When several sheets of cut paper are continuously fed, the automatic sheet feeder 73 is mounted on the printer main body 2 in place of the tractor device 45. In this case, it is possible to transmit the rotation from the output gear 18 to the input gear 76 of the automatic sheet feeder 73 by selecting a state where the rotation of the shift gear 22 is transmitted to the output gear 18 by the operation of the operating member 27. Thus, the cut paper 77 can be fed by the paper feeding roller of the automatic sheet feeder 73.

When the tractor device 45 is mounted on the printer 1, the permanent tractor 3 in the printer 1 and the auxiliary tractor 52 in the tractor device 45 can be selectively driven. Even when the tractor device 45 is employed, the permanent tractor 3 in the printer 1 can still be used. Correspondingly, the number of auxiliary tractors 52 provided in the tractor device 45 is decreased. Therefore, it is possible to reduce the cost of not only the printer 1 but also the tractor device 45.

Furthermore, the tractor device 45 can be driven utilizing the output gear 28 for driving the automatic sheet feeder 73. Therefore, it is possible to simplify the power transmitting structure, to miniaturize the printer 1 and particularly to decrease the width thereof.

Additionally, even in a state where the tractor device 45 is mounted, it is possible to feed the cut paper 77 by the manual setting table 47 formed on the upper surface of the tractor device 45. In this case, the operating member 27 in the printer main body 2 is operated to press the pinch roller 23 against the driving roller 10.

Figure 9:
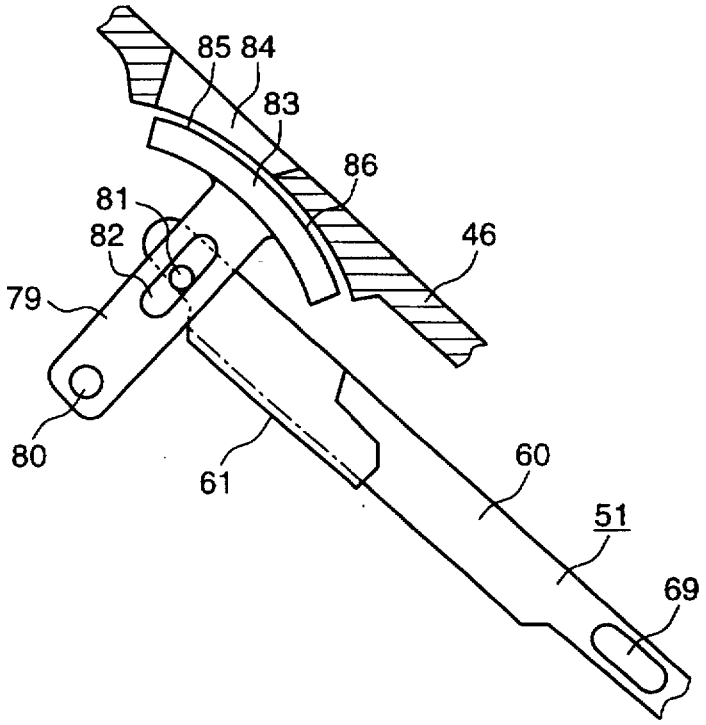
FIG. 9 is a vertical sectional side view of a second preferred embodiment of the present invention showing a periphery of a second power switching mechanism comprising a display section.
Figure 10:
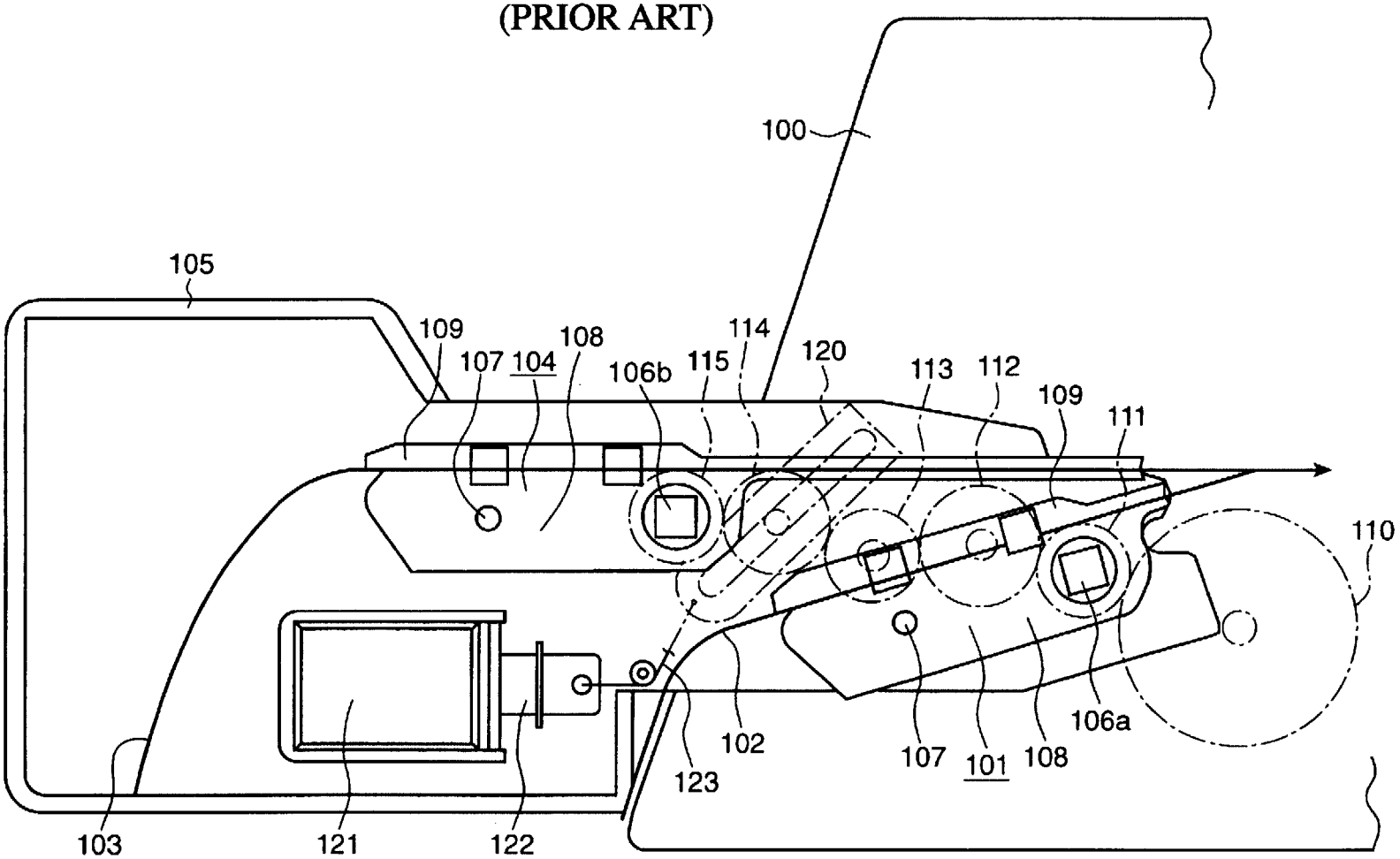
Fig. 10 (PRIOR ART)
FIG. 10 is a vertical sectional side view showing the prior art.
Figure 11:
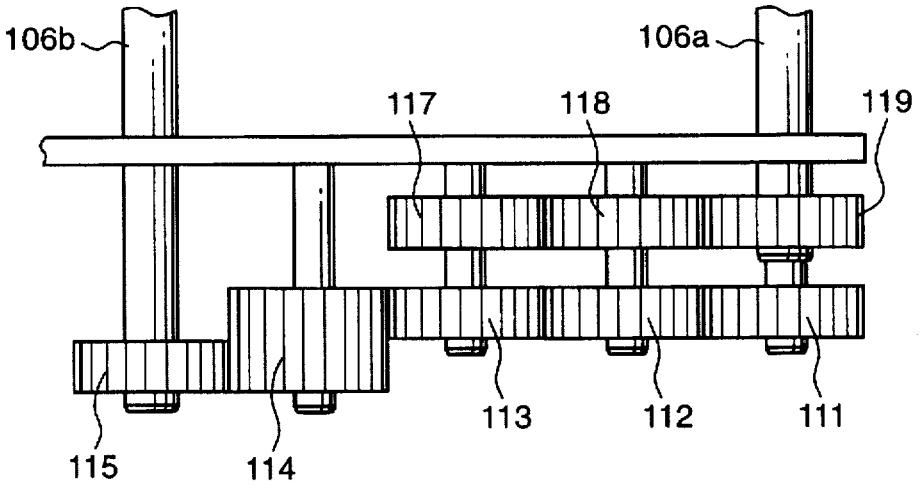
Fig. 11 (PRIOR ART)
FIG. 11 is a plan view showing an arrangement of gears for transmitting a drive force to a tractor.

A second embodiment of the present invention adds a display and will be described with reference to FIG. 9. The same sections as those in the first embodiment are assigned the same reference numerals and hence, the description thereof is not repeated. FIG. 9 is a longitudinal sectional view showing the periphery of a second drive force selecting mechanism 51 comprising a display section. Although only one part is illustrated, a display lever 79 is rotatably held by a supporting shaft 80 on a tractor device 45, and a long hole 82 fitted in a shaft 81 provided upright at an end of an operating lever 60 is formed in an intermediate portion of the display lever 79. An arc-shaped display plate 83 serving as a display section is provided at one end of the display lever 79. The display plate 83 can be visually observed from the exterior through a display window 84 formed on the upper surface of the tractor device 45.

The display plate 83 has a mark (not shown) at one end 85 indicating the use of the above-mentioned auxiliary tractor 52. The display plate has another mark (not shown) at the other end 86 indicating the use of the above-mentioned permanent tractor 3.

In a state where the operating lever 60 is moved toward the upper left to feed continuous paper 78 by the permanent tractor 3, as shown in FIG. 8 (B), with a tractor device mounted on a printer, a mark indicating that the permanent tractor 3 is being used is positioned in the display window 84. In a state where the operating lever 60 is moved toward the lower right to feed the continuous paper 78 by an auxiliary tractor 52 as shown in FIG. 8 (A), a mark indicating that the auxiliary tractor 52 is in it used state is positioned in the display window 84. Thus, it is possible to inform an operator which tractor is being used.

What is claimed is:

1. A printer, comprising:

a printing mechanism;

a paper guide path communicating with said printing mechanism;

a driving source having an output shaft generating a feeding force;

a permanent tractor located at a position communicating with said paper guide path for feeding a continuous sheet of paper, said permanent tractor having an input gear connected to the output shaft of said driving source, thereby applying the feeding force to the continuous sheet of paper through said permanent tractor;

an output gear connected to said output shaft of said driving source;

a drive force selecting mechanism for selectively transmitting a drive force from said driving source to one of said input gear of said permanent tractor and said output gear;

a movable operating member for operating said drive force selecting mechanism;

a slider connected to said operating member, said slider being slid by the movement of said operating member;

a cam member provided on said slider so that said cam member independently slides along the surface of said slider in a first state and also integrally slides with said slider in a second state, said cam member operating said drive force selecting mechanism by integrally sliding with said slider when said operating member is moved;

an external device connecting portion selectively allowing attachment and detachment of one of an automatic sheet feeder for successively feeding a plurality of cut sheets of paper and a tractor device for feeding a continuous sheet of paper so that a paper feed mechanism of one of said automatic sheet feeder and said tractor device communicates with said paper guide path and said output gear is connected to an input gear of said paper feed mechanism;

a second drive force selecting mechanism mounted in said tractor device for operating said drive force selecting mechanism by displacing independently said cam member; and a clutch member connected between the paper feed mechanism of said tractor device and said output gear.

2. A printer as recited in claim 1, wherein said drive force selecting mechanism comprises a shift gear adapted to be axially slid to thereby selectively mesh with one of said input gear of said permanent tractor and said output gear, and a mechanism for sliding said shift gear according to an operating of said operating member.

3. A printer as recited in claim 2, wherein said mechanism for sliding said shift gear comprises biasing means for biasing said shift gear in one direction to make said shift gear selectively mesh with one of said input gear of said permanent tractor and said output gear, and a mechanism for sliding said shift gear against a biasing force of said biasing means.

4. A printer as recited in claim 3, wherein said mechanism for sliding said shift gear against the biasing force of said biasing means comprises a cam mechanism.

5. A printer as recited in claim 1, wherein said operating member is pivotably operated, and a pivotal motion of said operating member is converted into a linear motion.

6. A printer as recited in claim 1, wherein said input gear meshes with said output gear, said clutch member comprises a rotating member which rotates around the axis of said input gear, an idle gear rotatably supported on said rotating member and always engaged with said input gear, an urging member for urging said rotating member in the direction in which said idle gear is engaged with a tractor gear of said tractor device, and a pressing section for pressing said rotating member to disengage said idle gear from said tractor gear when said second drive force selecting mechanism is moved in one direction.

7. A printer as recited in claim 1, wherein said external device connecting portion comprises means for fixing said external device in a clicking fashion.

8. A printer as recited in claim 7, wherein said external device connecting portion further includes a portion adapted to come into surface contact with said external device when said external device is mounted on the printer.

9. A printer as recited in claim 1 further comprising a display section for indicating the use of said permanent tractor or said tractor device in synchronism with the operation of said second drive force selecting mechanism.

10. A printer as recited in claim 9, wherein said display section comprises a display plate moved by the operation of said second drive force selecting mechanism, a mark formed in said display plate, and a display window visually observable said mark from the exterior.

11. A printer, comprising:

a printing mechanism;

a paper guide path communicating with said printing mechanism;

a driving source having an output shaft generating a feeding force;

a friction feed mechanism for receiving said drive force from said driving source, said friction feed mechanism including a drive roller and a pinch roller kept in separable contact with each other through said paper guide path;

a permanent tractor located at a position communicating with said paper guide path for feeding a continuous sheet of paper, said permanent tractor having an input gear connected to said output shaft of said driving source, thereby feeding a continuous sheet of paper;

an output gear connected to said output shaft of said driving source;

a drive force selecting mechanism for selectively transmitting said drive force from said driving source to one of said input gear of said permanent tractor and said output gear;

a movable operating member for operating said drive force selecting mechanism;

a separating mechanism connected with said operating member, said separating mechanism having a slider for selectively separating said drive roller and said pinch roller by an operation of said operating member;

a cam member provided on said slider so that said cam member independently slides along the surface of said slider in a first state and also integrally slides with said slider in a second state, said cam member operating said drive force selecting mechanism by integrally sliding with said slider when said operating member is moved;

an external device connecting portion selectively allowing attachment and detachment of one of an automatic sheet feeder for successively feeding a plurality of cut sheets of paper and a tractor device for feeding a continuous sheet of paper so that a paper feed mechanism of one of said automatic sheet feeder and said tractor device communicates with said paper guide path and said output gear is connected to an input gear of said paper feed mechanism;

a second drive force selecting mechanism mounted in said tractor device for operating said drive force selecting mechanism by displacing independently said cam member; and a clutch member connected between the paper feed mechanism of said tractor device and said output gear.

12. A printer as recited in claim 11, wherein said separating mechanism comprises a cam mechanism.

13. A printer as recited in claim 11, wherein said separating mechanism comprises a releasing member urged in one direction, a pin provided on said releasing member, and a projection mounted in said slider for separating said pinch roller from said driving roller by rotated the rotation of said releasing member in a direction opposite to said one direction.

14. A printer as recited in claim 11, wherein said second drive force selecting mechanism selectively transmits said drive force from said driving source to one of said input gear of said permanent tractor and said output gear, independently of said drive force selecting mechanism.

15. A printer as recited in claim 11, wherein said second drive force selecting mechanism comprises an operating lever and a driving mechanism which moves said operating lever.

16. A printer as recited in claim 15, wherein said driving mechanism includes a rack formed in said operating lever and a gear train engaged with said rack.

17. A printer as recited in claim 11 further comprising a display section for indicating the use of said permanent tractor or said tractor device in synchronism with the operation of said second drive force selecting mechanism.

18. A printer as recited in claim 17, wherein said display section comprises a display plate moved by the operation of said second drive force selecting mechanism, a mark formed in said display plate, and a display window visually observable said mark from the exterior.

* * * * *

UNITED STATES PATENT AND TRADEMARK OFFICE

CERTIFICATE OF CORRECTION

PATENT NO. : 5,746,525

DATED : May 5, 1998

INVENTOR(S) : Sanada, et. al.

It is certified that error appears in the above-identified patent and that said Letters Patent is hereby corrected as shown below:

Title page, item [75], inventor: change Tsuyosh Sanda to --Tsuyoshi Sanada--.

Signed and Sealed this

Twelfth Day of September, 2000

*Attest:*

Q. TODD DICKINSON

*Attesting Officer*

*Director of Patents and Trademarks*